United States Patent [19]

Bull

[11] Patent Number: 5,020,197

[45] Date of Patent: Jun. 4, 1991

[54] BODY POSITIONING DEVICE

[76] Inventor: David W. Bull, Rt. 2 Manilla Rd., P.O. Box 415, Englewood, Tenn. 37329

[21] Appl. No.: 566,839

[22] Filed: Aug. 13, 1990

[51] Int. Cl.[5] ..... A61G 1/00

[52] U.S. Cl. ..... 27/21.1; 27/12; 27/13

[58] Field of Search ..... 27/21.1, 23, 25, 12, 27/13

[56] References Cited

U.S. PATENT DOCUMENTS

| | | | |
|---|---|---|---|
| 1,934,918 | 11/1933 | Everson | 27/21.1 |
| 1,973,240 | 9/1934 | Werness et al. | 27/13 |
| 2,170,724 | 8/1939 | Marquardt . | |
| 2,465,781 | 3/1949 | Banta | 27/21.1 X |
| 2,795,838 | 6/1957 | McNeery . | |
| 3,104,446 | 9/1963 | Throop, Jr. . | |
| 3,234,623 | 2/1966 | Rector | 27/21.1 |
| 3,955,252 | 5/1976 | Reda | 27/12 |

*Primary Examiner*—Richard E. Chilcot, Jr.
*Attorney, Agent, or Firm*—Pitts and Brittian

[57] ABSTRACT

A body positioning device (10) for elevating, supporting and securing the legs of a cadaver (40) at various displacements from a supporting surface (42) for various procedures in preparation for burial. The body positioning device (10) comprises a first support (12), a second support (14), and a base (34). The first support (12) and second support (14) include receptacles or indentations (28) dimensioned to receive cadaver legs (40) and are connected such that the body positioning device (10) may be oriented in various positions to obtain a plurality of displacements of the cadaver legs (40) from a support surface (42). The base (34) acts as a cantilever to overcome the moment caused by the weight of the cadaver to prevent tilting of the body positioning device.

9 Claims, 2 Drawing Sheets

BODY POSITIONING DEVICE

DESCRIPTION

1. Technical Field

This invention relates to the preparation of deceased human bodies for burial. More specifically it relates to a device for supporting the legs of a cadaver, wherein the orientation of the device may be changed to adjust the elevation of the legs as desired for various purposes, such as to facilitate draining of fluids and cleaning and to elevate the legs proximate the knees to reduce the effective length of a body as it is placed in a casket such that an oversize casket is not necessary for taller bodies.

2. Background Art

It is known that when preparing a cadaver for burial, it is necessary to elevate the legs of the cadaver for several purposes. These purposes include draining bodily fluids, and cleaning and dressing the cadaver. It is also known that for a cadaver that is too long for a normal length casket, it is sometimes desirable to raise the knees of the cadaver to reduce the cadaver's effective length, thereby foregoing the added expense of a longer casket. It is also known that the desirable elevation of the cadaver's legs depends upon several factors including the procedure being performed and the weight and size of the cadaver. It is known that while preparing a cadaver for burial, it is necessary to secure the legs in such a way as to prevent rotation due to the effects of muscle relaxation, fluid drainage and rigor mortis.

In the past, blocks have been used to elevate the legs of cadavers, as have bottles. However, these prior art devices have certain disadvantages. Known body positioning devices are disclosed in U.S. Pat. Nos. 2,170,724, issued to R. E. Marquardt on Aug. 22, 1939; 2,795,838, issued to R. J. McNeely on June 18, 1957; and 3,104,446, issued to F. H. Throop, Jr. on Sept. 24, 1963. The Throop patent claims a foot positioner apparatus which provides a means for securing the feet of a cadaver, however, this patent only allows for a single elevation of the cadaver's legs. The Marquardt patent claims a mortician's appliance which allows a height adjustment, however, the feet of the cadaver are to be secured such that the legs will not bend as desired.

Therefore it is an object of this invention to provide a means for elevating and supporting the legs of a cadaver while preparing the cadaver for burial, with a means for selecting the desired elevation at which the cadaver legs are supported.

Another object of this invention is to provide a means for securing the legs of the cadaver at the various elevations to prevent the cadaver's legs from rotating.

DISCLOSURE OF THE INVENTION

Other objects and advantages over the prior art will be accomplished by the present invention which serves to elevate, support, and secure the legs of a cadaver at any of a variety of elevations. The body positioning device is fabricated from a semirigid, lightweight material such as polyvinylchloride pipe and includes a first support means which supports the cadaver's legs when the this first support means is oriented in a substantially upright position. In the preferred embodiment, this first support means includes two receptacles or indentations which are dimensioned to receive the legs of a cadaver. In another embodiment, the first support means is provided with telescoping legs such that the elevation of the cadaver's legs can be adjusted as necessary or desired. In this embodiment a fixing means is provided to secure the legs of the first support means at the desired elevation. A second support means is included which supports the cadaver's legs when this second support means is oriented in a substantially upright position. In the preferred embodiment, this second support means includes two receptacles or indentations which are dimensioned to receive the legs of a cadaver. Also in the preferred embodiment, the height of the second support means is not equal to the height of the first support means so that the device may be oriented in at least two positions to obtain different leg elevations. A base is included for engaging a support surface and preventing the device from tilting. In the preferred embodiment, this base includes the bottom portions of the first support means and the second support means. In the preferred embodiment, the first support means is connected to the second support means at substantially a right angle.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1:
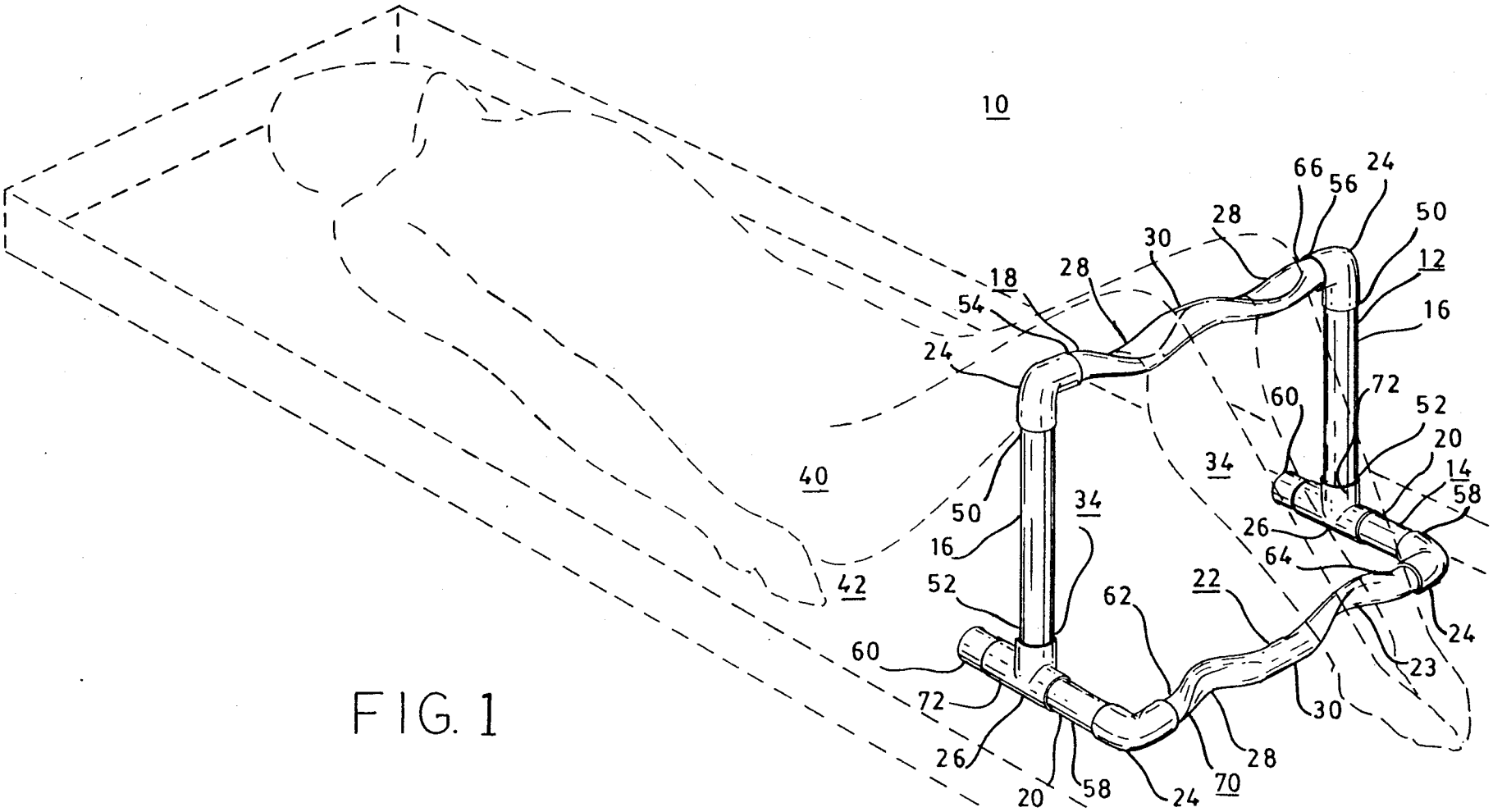
FIG. 1 illustrates a perspective view of the body positioning device constructed in accordance with the features of the present invention as the first support means is used to engage the support surface and the second support means is used to support the legs of a cadaver, with a support surface and cadaver in phantom.
Figure 2:
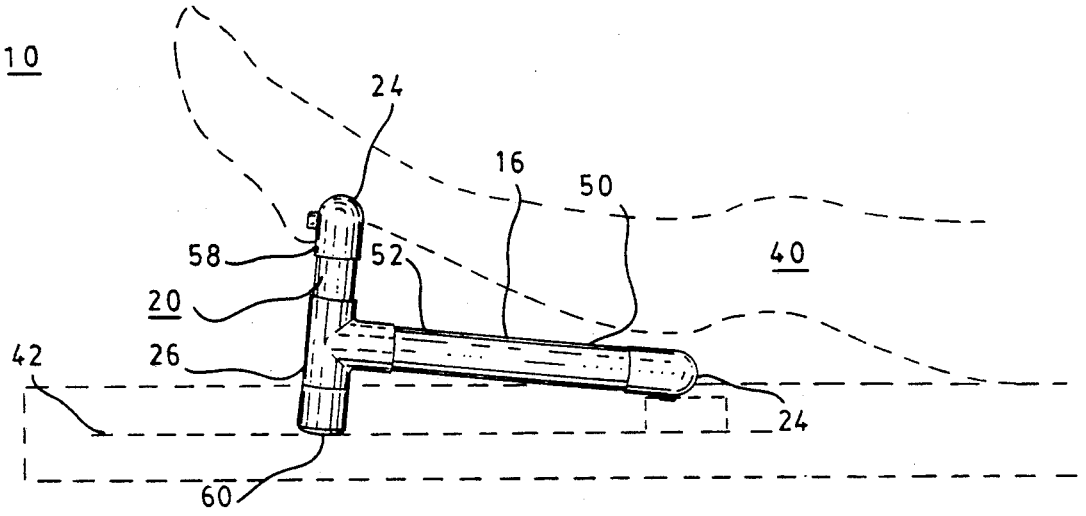
FIG. 2 illustrates a side view of the body positioning device shown in FIG. 1 where the device has been oriented so that the second support means engages the support surface and the first support means is used to support the weight of the cadaver, with a portion of a support surface and cadaver shown in phantom.
Figure 3:
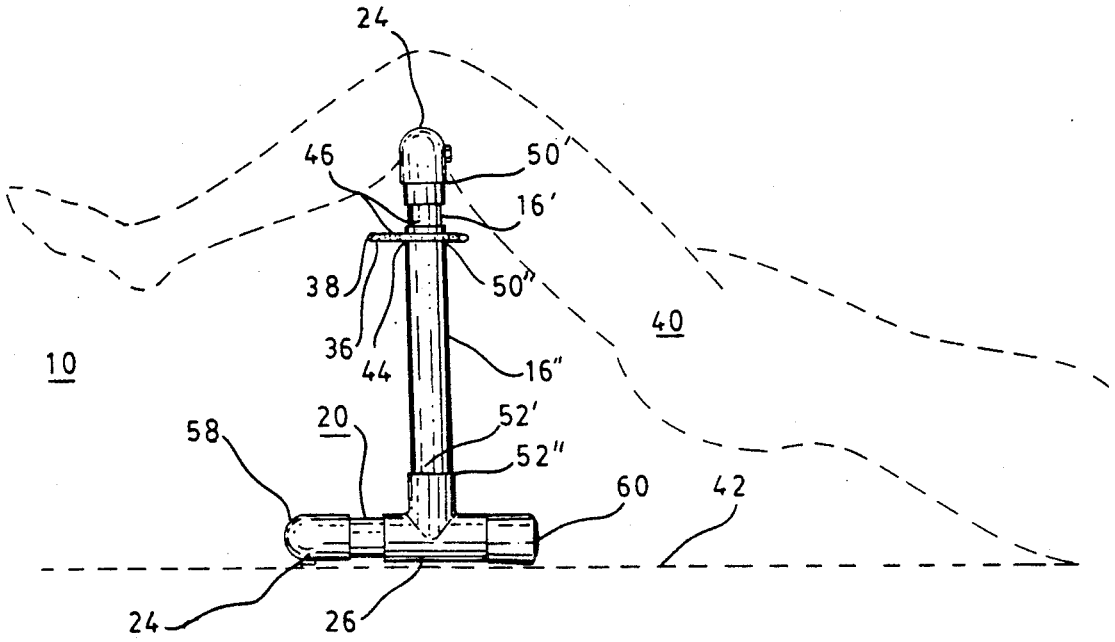
FIG. 3 illustrates the side view of an alternate embodiment of the device shown in FIG. 1 where the legs of the second support means are of a telescoping type.

A body positioning device incorporating various features of the present invention is illustrated generally at 10 in the figures. The device 10 serves to elevate, support, and secure cadaver legs 40 at any of a plurality of heights above the supporting surface 42.

The device 10 includes a first support means 12 for supporting and securing cadaver legs 40. The first support means 12 includes a top portion 66 and a bottom portion 68, the top portion 66 including two receptacles or indentations 28 dimensioned to receive cadaver legs 40 to prevent the cadaver legs 40 from rotating or falling from the device 10. In the preferred embodiment the first support means 12 is fabricated from a rigid or semirigid material such as polyvinylchloride piping or the like, with a substantially U-shaped configuration wherein the bottom portion 68 includes a first leg member 16 and a second leg member 16, and the top portion 66 includes a connecting member 18. Each leg member 16 of the preferred embodiment is defined by a tubular member with a first end 50 and a second end 52, and the connecting member 18 is defined by a tubular member with a first end 54, a second end 56. Two receptacles 28 are dimensioned to receive cadaver legs 40, the receptacles or indentations 28 being spaced apart and connected by a connecting segment 30. In the preferred embodiment the first end 50 of the first leg member 16 is connected to the first end 54 of the connecting member 18 at substantially a right angle by using an elbow connector 24 and the first end 54 of the second leg member 16 is conneCted to the second end 56 of the connecting member 18 at substantially a right angle by using an elbow connector 24.

The device 10 also includes a second support means 14 for supporting and securing cadaver legs 40. The second support means 14 includes a top portion 70 and a bottom portion 72. The top portion 70 of the second support means 14 includes two receptacles or indentations 28 dimensioned to receive cadaver legs 40 to prevent the cadaver legs 40 from rotating or falling from the device 10. In the preferred embodiment the second support means 14 is fabricated from polyvinylchloride piping or the like, with a substantially U-shaped configuration wherein the bottom portion 72 includes a first leg member 20 and a second leg member 20, and the top portion 70 includes a connecting member 22. Each leg member 20 of the preferred embodiment is defined by a tubular member in the depicted embodiment with a first end 58 and a second end 60. The connecting member 22 is defined by a tubular member with a first end 62, a second end 64, and two receptacles or indentations 28 dimensioned to receive cadaver legs 40, the receptacles 28 being spaced apart and connected by a connecting segment 30. In the preferred embodiment the first end 58 of the first leg member 20 is connected to the first end 62 of the connecting member 22 at substantially a right angle by using an elbow connector 24. The first end 58 of the second leg member 20 is connected to the second end 64 of the connecting member 22 at substantially a right angle by using an elbow connector 24.

A base 34 serves to support the device 10 on a supporting surface. The base 34 can be oriented such that either the first support 12 or second support 14 engages the legs of the cadaver. The depicted base 34 includes the bottom portion 68 of the first support means 12 and the bottom portion 72 of the second support means 14 and is used to engage a support surface 42 and to prevent the device 10 from tilting. The bottom portion 68 of the first support means 12 is connected to the bottom portion 72 of the second support means 14 such that when the first support means 12 is oriented in a substantially horizontal position the top portion 66 of the first support means 12 is used in conjunction with the base means 34 to engage the support surface 42 and to prevent the device 10 from tilting. When the second support means 14 is oriented in a substantially horizontal position the top portion 70 of the second support means 14 is used in conjunction with the base means 34 to engage the support surface 42 and to prevent the device 10 from tilting. In the preferred embodiment, the second end 52 of the first leg member 16 of the first support means 12 is connected along the first leg 20 of the second support means 14 at substantially a right angle by using a T-type connector 26 and the second end 52 of the second leg member 16 of the first support means 12 is connected along the second leg 20 of the second support means 14 at substantially a right angle by using a T-type connector 26.

In another embodiment, the first and second leg members 16 of the first support means 12 include a first diameter member 16' with a first end 50' and a second end 52', a second diameter member 16'' with a first end 50'' and a second end 52'', and a fixing means 36, the first diameter member 16' and second diameter member 16'' dimensioned such that the first diameter member 16' may be closely received by the second diameter 16''. The fixing means 36 includes a pin 38 of a selected diameter and a selected length, at least one opening 44 on at least one side of the diameter of the second diameter member 16'' proximate the first end 50 dimensioned to receive the pin 38, and a plurality of openings 46 on at least one side of the diameter of the first diameter member 16' dimensioned to receive the pin 38 and spaced at increments proximate the second end 52' to cooperate with the opening 44 in the second diameter member 16'' whereby the height of the device 10 may be selectively raised or lowered in a telescoping fashion.

From the foregoing description, it will be recognized by those skilled in the art that a body positioning device offering advantages over the prior art has been provided. Specifically, the body positioning device provides a means for elevating the legs of a cadaver at various heights by orienting the device in various positions. The device of the present invention also serves to secure the legs of the cadaver such that the legs will neither rotate nor fall from the device. Moreover, the device of the present invention is designed such that, in any orientation of the device, the base and the horizontally oriented support couple to act as a cantilever to overcome the moment caused by the weight of the cadaver to prevent tilting of the device, thereby allowing the device to be freestanding.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A body positioning device for supporting the legs of a cadaver at a selected displacement above a supporting surface by changing the orientation of said device comprising:

a first support means with top and bottom portions for supporting said cadaver's legs when said first support means is oriented in a substantially upright position;

a second support means with top and bottom portions for supporting said cadaver's legs when said second support means is oriented in a substantially upright position; and a base means for engaging a support surface and preventing said device from tilting, said base means including said bottom portions of said first support means and said second support means, said bottom portion of said second support means being connected to said bottom portion of said first support means such that when said first support means is oriented in a substantially horizontal position said top portion of said first support means is used in conjunction with said base means to engage said support surface and to prevent said device from tilting and when said second support means is oriented in a substantially horizontal position said top portion of said second support means is used in conjunction with said base means to engage said support surface and to prevent said device from tilting.

2. The body positioning device of claim 1 wherein said first support means includes two receptacles along said top portion dimensioned to receive the legs of a cadaver.

3. The body positioning device of claim 1 wherein said second support means includes two receptacles along said top portion dimensioned to receive the legs of a cadaver.

4. The body positioning device of claim 1 wherein said first support means is connected to said second support means at substantially a right angle.

5. A body positioning device for supporting the legs of a cadaver at a selected displacement above a supporting surface by changing the orientation of said device comprising:

a first support means with top and bottom portions for supporting said cadaver's legs when said first support means is oriented in a substantially upright position, said top portion including two receptacles dimensioned to receive the legs of a cadaver;

a second support means with top and bottom portions for supporting said cadaver's legs when said second support means is oriented in a substantially upright position, said top portion including two receptacles dimensioned to receive the legs of a cadaver; and a base means for engaging a support surface and preventing said device from tilting, including said bottom portions of said first support means and said second support means, said bottom portion of said second support means being connected to said bottom portion of said first support means at substantially a right angle such that when said first support means is oriented in a substantially horizontal position said top portion of said first support means is used in conjunction with said base means to engage said support surface and to prevent said device from tilting and when said second support means is oriented in a substantially horizontal position said top portion of said second support means is used in conjunction with said base means to engage said support surface and to prevent said device from tilting.

6. The body positioning device of claim 5 which is fabricated from a semirigid, lightweight material.

7. The body positioning device of claim 6 wherein said semirigid, lightweight material is polyvinylchloride piping.

8. The body positioning device of claim 5 wherein said first support means including a first leg member, a second leg member and a connecting member, each of said first and second leg members further including a first tubular member, a second tubular member and a fixing means, said first and second tubular members dimensioned such that said first tubular member may be closely received by said second tubular member, said fixing means fixing the position of said first tubular member in relation to said second tubular member such that the height of said first support member may be adjusted in a telescoping fashion.

9. A body positioning device for supporting the legs of a cadaver at a selected displacement above a supporting surface by changing the orientation of the device, which is fabricated of polyvinylchloride piping and comprises:

a first support means with top and bottom portions for supporting said cadaver's legs when said first support means is oriented in a substantially upright position, said first support means including a first leg member, a second leg member and a connecting member, each of said first and second leg members further including a first tubular member, a second tubular member and a fixing means, said first and second tubular members dimensioned such that said first tubular member may be closely received by said second tubular member, said fixing means fixing the position of said first tubular member in relation to said second tubular member such that the height of said first support member may be adjusted in a telescoping fashion, said connecting member including two receptacles dimensioned to receive the legs of a cadaver;

a second support means with top and bottom portions for supporting said cadaver's legs when said second support means is oriented in a substantially upright position, said top portion including two receptacles dimensioned to receive the legs of a cadaver; and a base means for engaging a support surface and preventing said device from tilting, including said bottom portions of said first support means and said second support means, said bottom portion of said second support means being connected to said bottom portion of said first support means at substantially a right angle such that when said first support means is oriented in a substantially horizontal position said top portion of said first support means is used in conjunction with said base means to engage said support surface and to prevent said device from tilting and when said second support means is oriented in a substantially horizontal position said top portion of said second support means is used in conjunction with said base means to engage said support surface and to prevent said device from tilting.

* * * * *